US005771865A

United States Patent [19]

Ishida

[11] Patent Number: 5,771,865

[45] Date of Patent: Jun. 30, 1998

[54] FUEL INJECTION SYSTEM OF AN ENGINE AND A CONTROL METHOD THEREFOR

[75] Inventor: Akio Ishida, Yokohama, Japan

[73] Assignee: Mitsubishi Jidosha Kogyo Kabushiki Kaisha, Tokyo, Japan

[21] Appl. No.: 795,805

[22] Filed: Feb. 5, 1997

[30] Foreign Application Priority Data

Feb. 7, 1996 [JP] Japan ..... 8-044071

[51] Int. Cl.[6] ..... F02M 37/04

[52] U.S. Cl. ..... 123/467; 123/447; 123/300

[58] Field of Search ..... 123/500, 501, 123/467, 458, 299, 300, 447

[56] References Cited

U.S. PATENT DOCUMENTS

| | | | |
|---|---|---|---|
| 3,837,324 | 9/1974 | Links | 123/458 |
| 3,851,635 | 12/1974 | Murtin | 123/458 |
| 4,168,688 | 9/1979 | Bart | 123/458 |
| 4,211,202 | 7/1980 | Hafner | 123/467 |
| 4,580,540 | 4/1986 | Babitzka | 123/458 |
| 4,603,671 | 8/1986 | Yoshinaga | 123/467 |
| 4,831,986 | 5/1989 | Linder | 123/300 |
| 5,176,120 | 1/1993 | Takahashi | 123/447 |
| 5,529,024 | 6/1996 | Wirbelfit | 123/447 |
| 5,622,152 | 4/1997 | Ishida | 123/447 |

*Primary Examiner*—Carl S. Miller

[57] ABSTRACT

A fuel injection system of an engine comprises a fuel tank, a fuel pressure pump for pressurizing a fuel supplied from the fuel tank, an injector connected to the fuel pressure pump by means of a fuel pipe. The injector includes a nozzle connected to the fuel pipe by means of a fuel passage, a pressure chamber into which the pressurized fuel is introduced from the fuel passage, and a nozzle valve for opening and closing the nozzle depending on the fuel pressure in the pressure chamber. The system further comprised a fuel return passage connecting the pressure chamber and the fuel tank, and first and second solenoid valves for determining the start and termination of fuel injection through the nozzle.

13 Claims, 3 Drawing Sheets

FUEL INJECTION SYSTEM OF AN ENGINE AND A CONTROL METHOD THEREFOR

BACKGROUND OF THE INVENTION

1. Field of the Invention

The present invention relates to a fuel injection system of an engine, capable of accurately controlling the beginning and termination of the fuel injection by utilizing open-close operation of solenoid valves, and a control method therefor.

2. Description of the Related Art

Conventionally, accumulator- or jerk-type fuel injection systems have been used in automotive diesel engines. These systems are each provided with an accumulator or pump chamber as a source of fuel supply, and the supply of a high-pressure fuel from the accumulator or pump chamber to a fuel injection valve is controlled by means of a single solenoid valve, that is, a three-port two-position directional control valve of the solenoid-operated type. More specifically, in the case of accumulator-type system, when the solenoid valve is in an injection start position, the solenoid valve connects a pressure chamber within the fuel injection valve to the low-pressure side, whereupon fuel injection from the injection valve is started. When the solenoid valve is shifted from the injection start position to an injection end position during the fuel injection, the solenoid valve disconnects the pressure chamber from the low-pressure side, whereupon the fuel injection from the injection valve ends.

More specifically, the fuel injection is started by shifting the single solenoid valve from the injection end position to the injection start position, and is terminated by then shifting the solenoid valve from the start position to the end position. The solenoid valve therefore should be switched at higher speed to carry out an adequate fuel injection in accordance with an engine output requested.

A delay is unavoidable before the solenoid of the solenoid valve is actually energized after the start of current supply thereto or before the solenoid of the solenoid valve is actually de-energized after the suspension of the current supply. In the situation that the switching operation of the solenoid valve should be done at a short period of time in a high speed zone of the engine, the solenoid valve switching operation cannot follow high-speed engine rotation.

In the case where the fuel injection is effected in two stages, pilot and main injection stages, in particular, the pilot injection cannot be carried out in optimum conditions.

SUMMARY OF THE INVENTION

The object of the present invention is to provide a fuel injection system, capable of coping with higher engine speeds and controlling the beginning and termination of the fuel injection with high accuracy, and a control method therefor.

The above object is achieved by a fuel injection system of an engine according to the present invention, which comprises: a fuel tank in which fuel can be stored; a fuel pressurizing device for pressurizing the fuel supplied from the fuel tank; an injector adapted to inject the fuel pressurized by the fuel pressurizing device into a cylinder of the engine when supplied with the pressurized fuel; a fuel supply passage connecting the fuel pressurizing device and the injector and used to supply the pressurized fuel from the fuel pressurizing device to the injector; a fuel return passage connecting the injector and the fuel tank and used to return the pressurized fuel from the injector to the fuel tank; and at least two solenoid valves arranged in the fuel return passage and adapted to be opened and closed to control fuel injection from the injector.

According to the fuel injection system described above, the beginning and termination of the fuel injection from the injector can be controlled by alternately switching first and second solenoid valves. In controlling the beginning and termination of the fuel injection, each of the solenoid valves therefore need not be switched more than once per injection. The beginning and termination of the fuel injection can thus be controlled with high accuracy even when the engine operation is in a high speed zone, by setting the switching manner of each solenoid valve in consideration of the unavoidable response delay for each valve switching cycle.

More specifically, the fuel injection system may further comprise an accumulator in the fuel supply passage. In this case, the injector includes a nozzle connected to the fuel supply passage by means of a connecting passage so that the pressurized fuel can be injected through the nozzle, a pressure chamber into which the pressurized fuel is introduced from the connecting passage, and a nozzle valve for opening and closing the nozzle depending on the fuel pressure in the pressure chamber. The fuel return passage connects the pressure chamber and the fuel tank, and the first and second solenoid valves are arranged in series in the fuel return passage.

When all the solenoid valves are opened to lower the fuel pressure in the pressure chamber, according to the fuel injection system described above, the nozzle valve is subjected to the pressure from the pressurized fuel, thereby opening the nozzle to allow the pressurized fuel to be injected through the nozzle.

When one of the solenoid valves is closed to increase the fuel pressure in the pressure chamber during the fuel injection, thereafter, the nozzle valve is closed under the pressure in the pressure chamber so that the fuel injection through the nozzle is stopped.

Further, the injector may include a nozzle connected to the fuel supply passage by means of a connecting passage so that the fuel is injected through the nozzle and a nozzle valve for opening and closing the nozzle. The nozzle valve has a needle and a spring for urging the needle in the direction to close the nozzle. In this case, the fuel return passage includes a pair of passage portions connected to the connecting passage and arranged in parallel with each other, and at least one solenoid valve is provided for each of the passage portions.

When the fuel pressure in the connecting passage increases so that the needle of the nozzle valve is lifted against the urging force of the spring to open the nozzle with all the solenoid valves in the passage portions closed, according to the fuel injection system described above, the nozzle valve allows the fuel to be injected through the nozzle.

When the solenoid valve in one of the passage portions is opened so that the fuel pressure in the connecting passage is lowered during the fuel injection, thereafter, the needle of the nozzle valve is subjected to the urging force of the spring to close the nozzle, thereby stopping the fuel injection at this point of time.

The aforementioned object is also achieved by a control method for a fuel injection system. The fuel injection system to which this control method is applied comprises a fuel tank in which fuel can be stored, a fuel pressurizing device for pressurizing the fuel supplied from the fuel tank, an injector adapted to inject the pressurized fuel into a cylinder of the engine, a fuel supply passage connecting the fuel pressurizing device with the injector and used to supply the pressurized fuel from the fuel pressurizing device to the injector, the injector having a nozzle connected to the fuel supply passage by means of a connecting passage so that the fuel can be injected through the nozzle, a pressure chamber into which the pressurized fuel is introduced from the connecting passage, and a nozzle valve for opening and closing the nozzle depending on the fuel pressure in the pressure chamber, a fuel return passage connecting the pressure chamber and the fuel tank and used to return the pressurized fuel from the pressure chamber to the fuel tank, and first and second solenoid valves arranged in series in the fuel return passage.

The control method applied to the fuel injection system described above comprises: an injection starting step for opening the first and second solenoid valves in order to lower the fuel pressure in the pressure chamber, thereby opening the nozzle valve, and injecting the pressurized fuel through the nozzle; and an injection terminating step for closing the second solenoid valve during fuel injection in order to increase the fuel pressure in the pressure chamber, thereby closing the nozzle valve, and stopping the fuel injection through the nozzle.

The control method may further comprise an injection preparation step for keeping the second solenoid valve in the closed position thereof and the first solenoid valve in the open position thereof, respectively, to provide for another fuel injection cycle after the fuel injection is stopped. When the second solenoid valve is opened after the injection preparation step is carried out, in this case, the nozzle valve injects the fuel through the nozzle.

Furthermore, a multiple-fuel-injection can be carried out for each combustion stroke of the engine, and the multiple-fuel-injection may include pilot injection and main injection, for example.

In the case where the fuel injection includes preceding fuel injection and succeeding fuel injection, the preceding fuel injection has an injection preparation step for opening the second solenoid valve and closing the first solenoid valve, an injection starting step for opening the first solenoid valve to start the fuel injection, and an injection terminating step for closing the second solenoid valve to stop the fuel injection, and the succeeding fuel injection has an injection preparation step for keeping the second solenoid valve in the closed position thereof and the first solenoid valve in the open position thereof, an injection starting step for opening the second solenoid valve to start the fuel injection, and an injection terminating step for closing the first solenoid valve to terminate the fuel injection.

Moreover, the control method of the present invention is also applicable to another fuel injection system, which comprises a fuel tank in which fuel can be stored, a fuel pressurizing device for pressurizing the fuel supplied from the fuel tank, an injector adapted to inject the pressurized fuel into a cylinder of the engine, a fuel supply passage connecting the fuel pressurizing device and the injector and used to supply the pressurized fuel from the fuel pressurizing device to the injector, the injector having a nozzle connected to the fuel supply passage by means of a connecting passage, a needle for opening and closing the nozzle, and a spring for urging the needle in the direction to close the nozzle a fuel return passage connecting the connecting passage and the fuel tank and including first and second passage portions parallel to each other, and first and second solenoid valves provided for each of the passage portions, respectively.

The control method applied to the fuel injection system described above comprises: an injection starting step for closing all the solenoid valves in the passage portions in order to increase the fuel pressure in the connecting passage, thereby causing the needle to open the nozzle against the urging force of the spring, and injecting the fuel through the nozzle; and an injection terminating step for opening the first solenoid valve during fuel injection in order to lower the fuel pressure in the connecting passage, thereby causing the needle to close the nozzle by means of the urging force of the spring, and stopping the fuel injection through the nozzle.

In this case, the control method may further comprise an injection preparation step for keeping the second solenoid valve in the closed position and the first solenoid valve in the open position, respectively, to provide for another fuel injection cycle after the fuel injection is stopped.

In the case where the fuel injection includes preceding fuel injection and succeeding fuel injection, the preceding fuel injection has an injection preparation step for opening the second solenoid valve in the second passage portion and closing the first solenoid valve in the first passage portion, an injection starting step for closing the second solenoid valve to start the fuel injection, and an injection terminating step for opening the first solenoid valve to stop the fuel injection, and the succeeding fuel injection has an injection preparation step for keeping the second solenoid valve in the closed position thereof and the first solenoid valve in the open position thereof, an injection starting step for closing the first solenoid valve to start the fuel injection, and an injection terminating step for opening the second solenoid valve to terminate the fuel injection.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
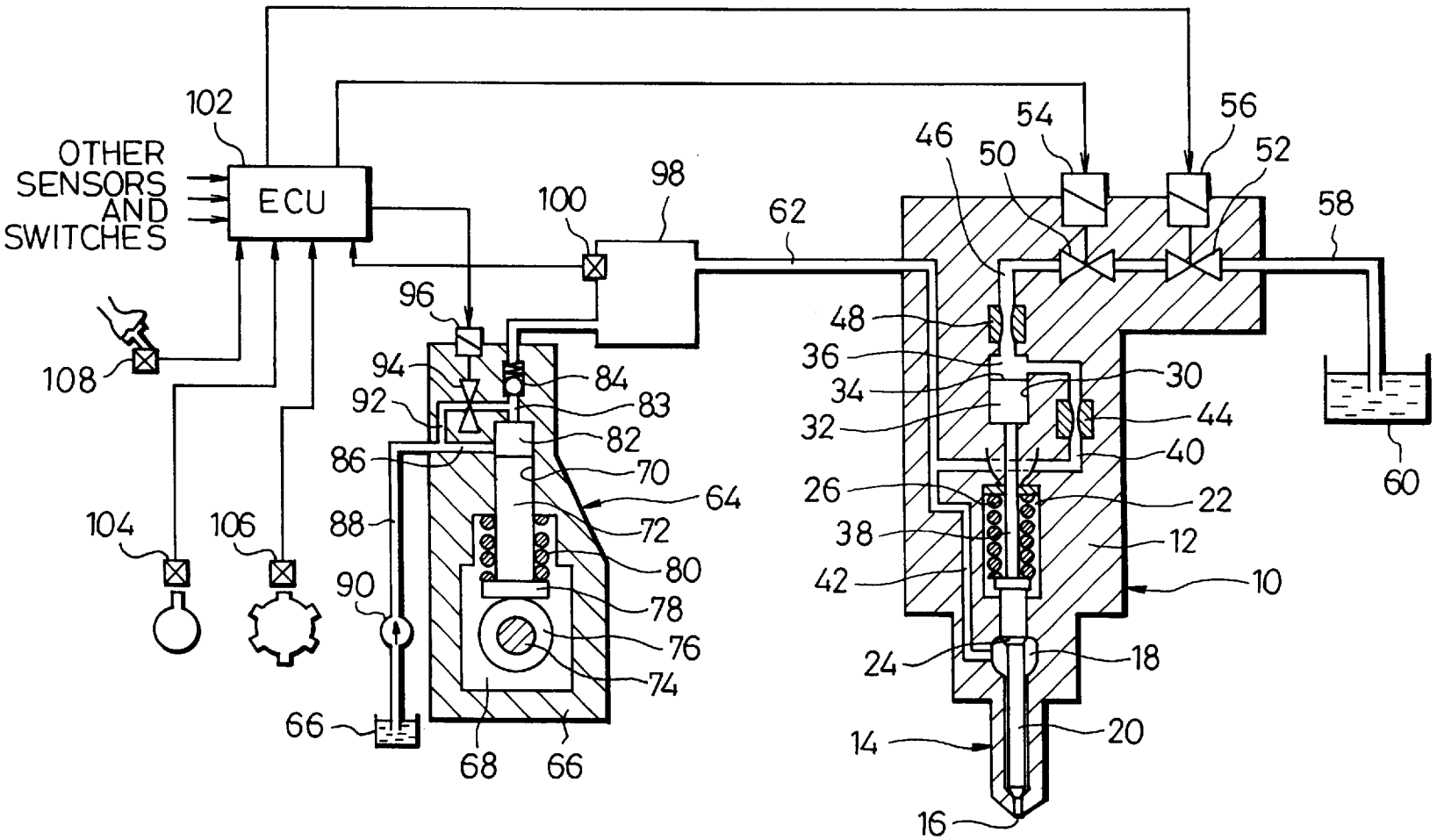
FIG. 1 is a schematic view showing an accumulator-type fuel injection system.

Referring to FIG. 1, there is shown an accumulator-type fuel injection system that is applied to an engine of an automobile. This fuel injection system is provided with a fuel injection unit 10 for each cylinder. The fuel injection unit 10 has a nozzle holder 12 as its housing. A nozzle body 14 protrudes from one end of the holder 12, and a plurality of nozzles 16 are formed in the tip end of the body 14. The number of nozzles is not critical for the present invention, therefore, it may be design choice. Also, a fuel puddle 18 is formed in the body 14. In FIG. 1, the nozzle holder 12 and the nozzle body 14 are shown in an integral form for ease of illustration.

The nozzle body 14 contains a slidable nozzle needle 20 therein. Extending from the side of the nozzles 16, the needle 20 projects into a spring chamber 22 via the fuel puddle 18. The chamber 22 is defined in the nozzle holder 12. Referring to FIG. 1, the nozzle needle 20 includes a small-diameter portion on the side of the nozzles 16 and a large-diameter portion on the side of the spring chamber 22. The boundary between the small- and large-diameter portions forms a tapered surface 24 that faces the inside of the fuel puddle 18. The spring chamber 22 contains therein a valve spring 26 that is formed of a compression coil spring. The spring 26 presses the nozzle needle 20 downward as in FIG. 1, whereby the lower end or tapered end of the needle 20 closes the nozzles 16.

A plurality of grooves are formed along the axis of the nozzle needle 20, between the nozzle body 14 and the needle 20. These grooves extend from the fuel puddle 18 to the tip end of the needle 20. Thus, when the nozzle needle 20 is lifted up (FIG. 1) the nozzles 16 communicate with the fuel puddle 18.

Further, a cylinder bore 30 is formed in the nozzle holder 12. The bore 30 is situated coaxial with the nozzle needle 20 so that the spring chamber 22 is interposed between the bore 30 and the needle 20. A piston 32 is slidably fitted in the cylinder bore 30, and one end face of the piston 32, that is, an end face 34 opposite from the nozzle needle 20, defines a pressure chamber 36 in the bore 30. The one end face 34 of the piston 32 has a pressure receiving area larger than that of the aforesaid tapered surface 24 of the needle 20.

A push rod 38 protrudes coaxially from the lower end of the piston 32. The rod 38 slidably penetrates a guide hole in the nozzle holder 12, and extends in the spring chamber 22. When the piston 32 is in the position illustrated, the lower end of the push rod 38 abuts against the upper end of the nozzle needle 20.

A high pressure passage 40 extends from the pressure chamber 36, and is connected to a fuel passage 42. These passages 40 and 42 are defined in the nozzle holder 12. An orifice 44 is inserted in the high pressure passage 40, whereby the flow area of the high pressure passage 40 is reduced. The fuel passage 42 connects at one end thereof with the fuel puddle 18, while opens at the other end thereof on the outer surface of the holder 12.

A low pressure passage 46 is defined in the nozzle holder 12. The low pressure passage 46, like the high pressure passage 40, extends from the pressure chamber 36, and opens onto the outer surface of the holder 12. An orifice 48 and first and second solenoid valves 50 and 52 are inserted in series into the low pressure passage 46 from the side of the pressure chamber 36. The orifice 48 serves to reduce the flow area of the low pressure passage 46. The first and second solenoid valves 50 and 52 are normally-closed on-off valves that are adapted to open the low pressure passage 46 when their respective solenoids 54 and 56 are energized and to close the passage 46 by means of the urging force of their respective return springs when the solenoids 54 and 56 are de-energized.

The solenoid valves 50 and 52, however, may be normally-open valves, or a combination of normally-open and normally-closed.

An open end of the low pressure passage 46 is connected with a fuel tank 60 via a return pipe 58.

On the other hand, an open end of the high pressure passage 40 is connected with a discharge port of a fuel pressure pump 64 via a fuel pipe 62. The pressure pump 64 has a pump housing 66, which defines a cam chamber 68 therein. A cylinder bore 70 is formed in the housing 66, and its one end opens into the cam chamber 68. A plunger 72 slidably is fitted in the bore 70, and its one end projects into the chamber 68. A camshaft 74 is located in the cam chamber 68, and extends at a right angles to the plunger 72. A cam 76 is mounted on the camshaft 74. The camshaft 74 is connected to a crankshaft of the engine by means of a power transmission system (not shown), and is rotated in association with the crankshaft.

A flange 78 is formed on the one end of the plunger 72, and a return spring 80 is disposed between the flange 78 and the inner surface of the cam chamber 68. The spring 80 is a compression coil spring that surrounds that portion of the plunger 72 which projects into the chamber 68, and urges the plunger 72 toward the cam 76. Thus, the flange 78 on the plunger 72 is pressed against the cam 76 by the return spring 80.

When the camshaft 74 is rotated, the cam 76, in conjunction with the urging force of the return spring 80, causes the plunger 72 to reciprocate. The camshaft 74 and the cam 76 may be replaced with an eccentric shaft that is rotatable in association with the crankshaft of the engine.

The one end face of the plunger 72 defines a pump chamber 82 in the cylinder bore 70. The chamber 82 is connected to the aforesaid discharge port or the fuel pipe 62 by means of a discharge passage 83. A check valve 84 is inserted in the passage 83, and allows a fuel to flow only from the pump chamber 82 toward the fuel pipe 62.

A fuel suction passage 86 is formed in the pump housing 66. One end of the suction passage 86 communicates with the pump chamber 82, while the other end opens to the outer surface of the housing 66. An open end of the fuel suction passage 86 is connected to a fuel suction pipe 88, which is connected to the aforesaid fuel tank 60. A feed pump 90 is inserted in the suction pipe 88. The feed pump 90 can feed the fuel sucked in from the fuel tank 60 to the pump chamber 82 through the fuel suction pipe 88 and the fuel suction passage 86.

Further, a fuel escape passage 92 is formed in the pump housing 66. One end of the passage 92 is connected to that part of the discharge passage 83 which is situated between the pump chamber 82 and the check valve 84. The other end of the passage 92 is connected to the fuel suction passage 86. A solenoid-operated spill valve 94 is inserted in the fuel escape passage 92. When its solenoid 96 is energized, the valve 94 allows the passage 92 to open.

An accumulator 98 having a given capacity is inserted in the middle of the fuel pipe 62. Also, the accumulator 98 is connected to fuel injection valves, which are combined with other cylinders of the engine, by means of other fuel pipes. Thus, the fuel injection system is of a common-rail type.

A pressure sensor 100 is attached to the accumulator 98, and is connected electrically to an electronic control unit (ECU) 102. The sensor 100 detects the fuel pressure in the accumulator 98, and supplies its detection signal to the ECU 102.

Besides the pressure sensor 100, a cylinder discriminating sensor 104, crank angle sensor 106, accelerator sensor 108, and other sensors and switches are connected electrically to the input side of the ECU 102. The sensor 104 discriminates the individual cylinders of the engine. The sensor 106 detects the engine speed and the crank angle of the crankshaft. The sensor 108 detects the engine load, that is, the depth of depression of the accelerator pedal. The other sensors and switches are used to detect atmospheric temperature, atmospheric pressure, fuel temperature, etc. that influence the operating conditions of the engine. Detection signals and setup signals from these sensors and switches are also supplied to the ECU 102.

Moreover, solenoids 50, 52, 96 of the aforesaid first and second solenoid valves 50 and 52 and the spill valve 94 are connected electrically to the output side of the ECU 102.

The following is a description of the operation of the fuel injection system constructed in this manner.

At first, the solenoids of the first and second solenoid valves 50 and 52 and the spill valve 94 are not energized by the ECU 102, so that the valves 50, 52 and 94 are off. In other words, these valves 50, 52 and 94 are in their respective closed positions.

When the engine is started in this state, the feed pump 90 is actuated, and at the same time, the camshaft 74 of the fuel pressure pump 64 is rotated, whereupon the plunger 72 reciprocates. The reciprocation of the plunger 72 causes the fuel supplied from the feed pump 90 to be introduced into the pump chamber 82, and pressurizes the introduced fuel to high pressure. Thus, the high-pressure fuel is fed from the chamber 82 into the accumulator 98 through the discharge passage 83. The fuel in the pump chamber 82 can be pressurized as the plunger 72 itself closes the open end of the fuel suction passage 86.

If the fuel pressure in the accumulator 98 is not lower than a predetermined value (e.g., 20 to 120 Mpa), the ECU 102 controls the current supply to the solenoid 96 of the spill valve 94 in response to a detection signal from the fuel pressure sensor 100, thereby opening and closing the valve 94. Thereupon, the fuel pressure in the accumulator 98 is kept at the predetermined value. Since the predetermined value of the accumulator pressure is changed depending on the operating conditions of the engine, a fuel pressure fit for the engine operating conditions is secured continually in the accumulator 98.

On the other hand, accumulator 98 re fuel in the accumulator 98 is introduced into the fuel passage 42 of the fuel injection unit 10 through the fuel pipe 62, and is supplied from the fuel passage 42 to the fuel puddle 18. Also, the fuel in the fuel passage 42 is fed into the pressure chamber 36 through the high pressure passage 40 and the orifice 44. Thus, the high-pressure fuel is introduced also into the chamber 36.

When the fuel pressure in the fuel puddle 18 is applied to the tapered surface 24 of the nozzle needle 20, it is inclined to push up the needle 20 in the direction to open the nozzles 16, resisting the urging force of the valve spring 26.

If either or both of the first and second solenoid valves 50 and 52 are closed, however, the fuel or fuel pressure in the pressure chamber 36 cannot run into the fuel tank 60 on the low-pressure side through the return pipe 58. Since the pressure receiving surface 34 of the piston 32 has a pressure receiving area larger than that of the tapered surface 24 of the nozzle needle 20, moreover, the piston 32 is kept in the position shown in FIG. 1. Accordingly, the piston 32, as well as the valve spring 26, causes the push rod 38 to press the needle 20 in the direction to close the nozzles 16, whereupon the nozzles 16 are kept closed by the needle 20.

The following is a description of fuel injection control based on the operation of the ECU 102 for opening and closing the first and second solenoid valves 50 and 52.

Preparation for Fuel Injection

The ECU 102 energizes the solenoid 56 of the second solenoid valve 52, thereby shifting the position of the valve 52 from the closed position or off position to its open position. During preparation for injection, therefore, only the second solenoid valve 52 is open. Since the first solenoid valve 50 is closed in this state, however, the fuel in the pressure chamber 36 is kept at high pressure, and the nozzles 16 are closed by the nozzle needle 20.

Start of Fuel Injection

When the final stage of a compression stroke for a corresponding cylinder is reached, the ECU 102 energizes the solenoid 54 of the first solenoid valve 50, thereby causing the valve 50 to open. In this state, the second solenoid valve 52 is kept in its open position.

In this case, both the first and second solenoid valves 50 and 52 are open, so that the high pressure fuel in the pressure chamber 36 is allowed to go to the low-pressure side through the orifice 48 and the low pressure passage 46. On the other hand, the flow of the fuel introduced into the chamber 36 through the high pressure passage 40 is restricted by the orifice 44.

Accordingly, the fuel pressure in the pressure chamber 36 lowers at once, so that the nozzle needle 20 is pushed up against the urging force of the valve spring 26 by the fuel pressure in the fuel puddle 18, that is, the fuel pressure that acts on the tapered surface 24 of the nozzle needle 20. At this point of time, the nozzles 16 are opened, whereupon the high-pressure fuel is injected into a combustion chamber (not shown) of the corresponding cylinder through the nozzles 16. This fuel injection is continued as the high-pressure fuel is supplied from the accumulator 98.

Termination of Fuel Injection

When a predetermined quantity of fuel is injected into the combustion chamber of the cylinder, that is, after the passage of a predetermined time since the start of fuel injection, the ECU 102 stops the current supply to the solenoid 56 of the second solenoid valve 52, and continues the current supply to the solenoid 54 of the first solenoid valve 50. Accordingly, the second valve 52 is shifted from the open position to the closed position or off position by means of the urging force of its return spring, while the first valve 50 is kept in its open position.

Thus, the low pressure passage 46 is closed, so that the outflow of the fuel from the pressure chamber 36 is stopped, while the pressure from the high-pressure fuel is fed into the chamber 36 through the high pressure passage 40 and the orifice 44. As a result, the increase of the fuel pressure in the chamber 36 causes the piston 32 and the push rod 38 to push down the nozzle needle 20 in addition to the urging force of the valve spring 26. At this point of time, the nozzles 16 are closed by the needle 20, whereupon the fuel injection ends.

Table 1 below shows the respective states of the first and second solenoid valves 50 and 52 switched in the aforesaid manner by the ECU 102.

TABLE 1

| | Solenoid 54 Valve 50 | Solenoid 56 Valve 52 |
|---|---|---|
| Preparation for | Off | On |
| Fuel Injection | Closed | Open |
| Start of | On | On |
| Main Injection | Open | Open |
| Termination of | On | Off |
| Main Injection | Open | Closed |

As seen from Table 1 above, the beginning of the fuel injection beginning is determined when the solenoid 54 of the first solenoid valve 50 is energized, that is, when the valve 50 is opened. The termination of the fuel injection is determined when the solenoid 52 of the second solenoid valve 52 is de-energized, that is, when the valve 52 is restored to its closed position.

Thus, the beginning of the fuel injection is controlled by switching the first solenoid valve 50, while the termination of the fuel injection is controlled by switching the second solenoid valve 52. Since the first and second valves 50 and 52 need not be switched more than once per injection, therefore, a delay in response to the switching never exerts bad influences upon the start and termination of the fuel injection. In consequence, the beginning and termination of the fuel injection, and injection quantity can be controlled highly accurately even though the engine speed is in a high-speed zone.

The operating states of the first and second solenoid valves 50 and 52 shown in Table 1 can be replaceable with each other.

In the case where pilot injection is carried out before main fuel injection, the ECU 102 controls the switching of the first and second solenoid valves 50 and 52 in the manner shown in Table 2 below.

TABLE 2

| | Solenoid 54 Valve 50 | Solenoid 56 Valve 52 |
|---|---|---|
| Preparation for | Off | On |
| Pilot Injection | Closed | Open |
| Start of | On | On |
| Pilot Injection | Open | Open |
| Termination of | On | Off |
| Pilot Injection | Open | Closed |
| Preparation for | On | Off |
| Main Injection | Open | Closed |
| Start of | On | On |
| Main Injection | Open | Open |
| Termination of | Off | On |
| Main Injection | Close | Open |

In the preparation for the pilot injection, the first and second solenoid valves 50 and 52 are switched in the same manner as in the preparation for the main injection.

Figure 2:
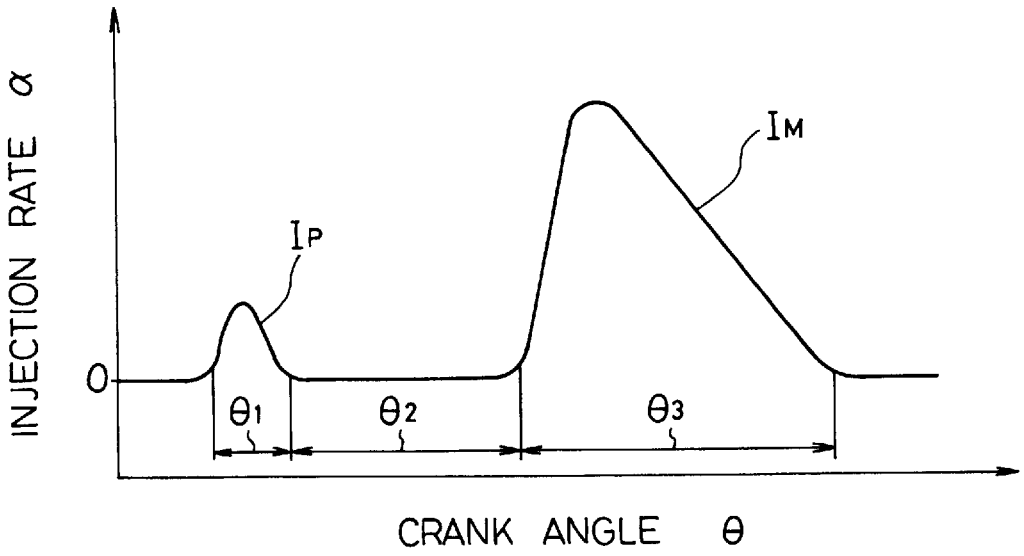
FIG. 2 is a graph showing patterns for pilot injection and main injection.

When the switching of the first and second solenoid valves 50 and 52 is controlled by the ECU 102 according to Table 2, the fuel is injected in two stages, the pilot and main injection stages, as shown in FIG. 2. The respective beginnings and terminations of the pilot and main injections can be controlled with high accuracy, since they are determined by switching one of the first and second solenoid valves 50 and 52, as in the aforesaid case.

In FIG. 2, the axes of abscissa and ordinate represent a crank angle $\theta$ of the engine and a fuel injection rate $\alpha$, respectively. Where the injection quantity is Q, the fuel injection rate $\alpha$ is given by $\alpha = dQ/d\theta$. In the pilot injection $I_p$, as seen from FIG. 2, the fuel is injected in a quantity equal to, e.g., 10% of the total injection quantity during a period for a crank angle $\theta_1$. After an interval of $\theta_2$ in terms of the crank angle $\theta$, all the residual fuel is injected as the main injection $I_M$ during a period for a crank angle $\theta_3$, which is longer than the period for $\theta_1$.

If the pilot injection is carried out accurately and appropriately before the main injection, as mentioned before, nitrogen oxides ($NO_x$) in exhaust gas from the engine can be reduced, and the level of combustion noises can be lowered without loss of engine performance.

In the above embodiment, the low pressure passage 46 is provided with two solenoid valves, that is, the first and second valves 50 and 52. However, more than two valves may be inserted into the low pressure passage 46.

Figure 3:
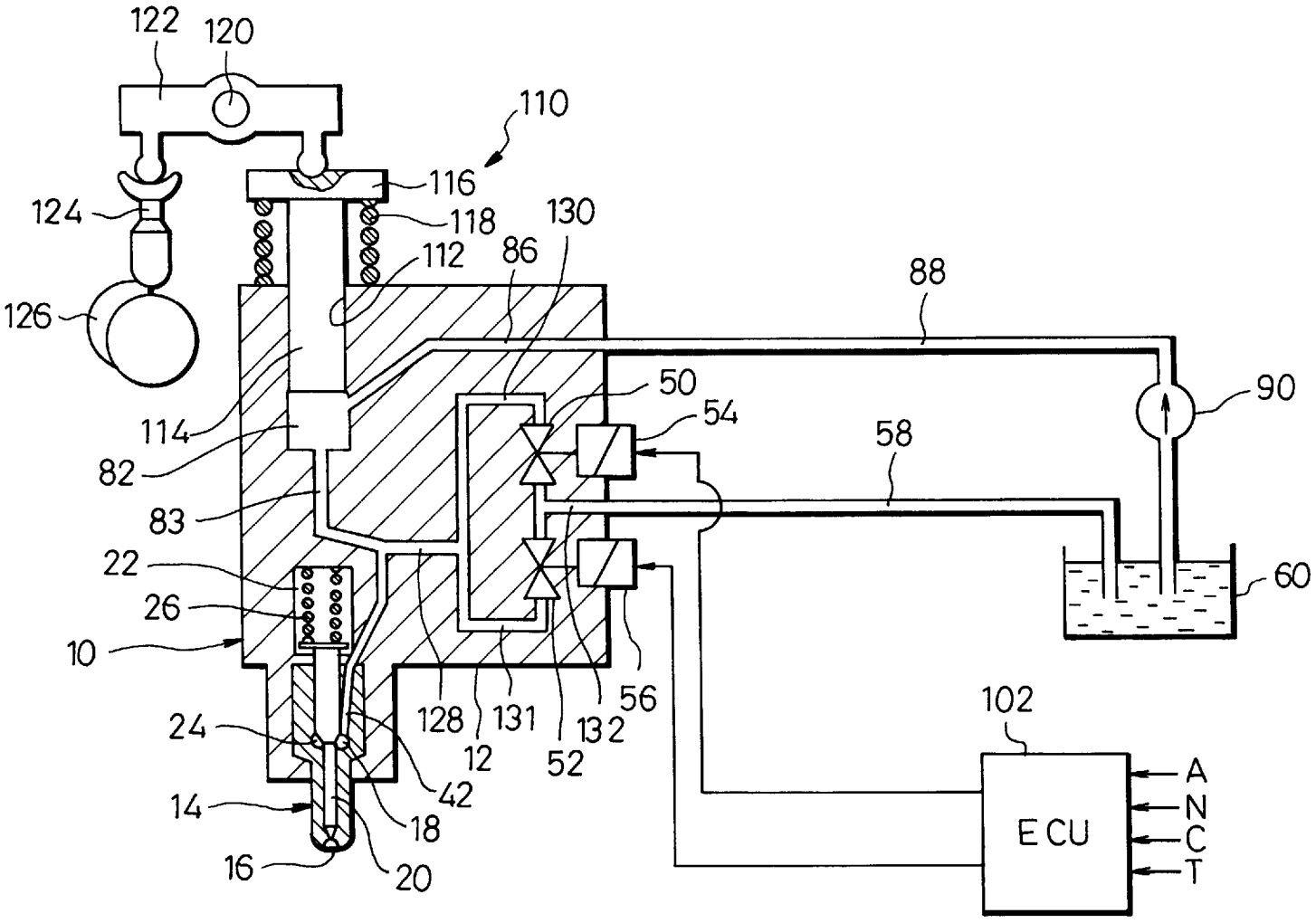
FIG. 3 is a schematic view showing a jerk-type fuel injection system.

Referring now to FIG. 3, there is shown a jerk-type fuel injection system. In order to avoid repetition, in the description of the fuel injection system of FIG. 3 to follow, like reference numerals are used to designate those members and portions which have the same functions as their counterparts in the fuel injection system shown in FIG. 1.

In the fuel injection system of FIG. 3, a fuel pressure pump 110 is incorporated in a nozzle holder 12 of a fuel injection valve 10. The pressure pump 110 has a cylinder bore 112 that is formed in the holder 12, and a plunger 114 is slidably fitted in the bore 112. One end of the plunger 114 projects from the nozzle holder 12, and is formed with a flange 116. A return spring 118 is disposed between the flange 116 and the holder 12. The spring 118, which is formed of a compression coil spring surrounding the plunger 114, urges the plunger 116 upward as in FIG. 3. A rocker shaft 120 is secured above the plunger 114, and a rocker arm 122 is rockably supported on the shaft 120.

A pusher on one end of the rocker arm 122 abuts against one end of the plunger 114, while another pusher on the other end of the arm 122 is in contact with a tappet 124 that abuts against a cam 126. The cam 126 is rotated in association with the crankshaft of the engine. In the state shown in FIG. 3, the plunger 114 is subjected to the urging force of the return spring 118, and urges the rocker arm 122 to rock in the counterclockwise direction in FIG. 3.

The other end face of the plunger 114 defines a pump chamber 82 in the cylinder bore 112, and the chamber 82 communicates with a fuel passage 42 by means of a discharge passage 83.

Also, the pump chamber 82 is connected to a feed pump 90 by means of a fuel feed passage 86 and a fuel feed pipe 88.

A connecting passage 128 extends from the fuel passage 42. The passage 128 diverges into first and second control passages 130 and 131, which join a return passage 132. The passage 132 is connected to a fuel tank 60 via a return pipe 58. First and second solenoid valves 50 and 52 are inserted in the first and second control passages 130 and 131, respectively. In this case, therefore, the valves 50 and 52 are arranged in parallel with each other.

The input side of the ECU 102 is supplied with several pieces of information, including an accelerator opening A, engine speed N, rotational angle C of the cam 126, atmospheric temperature, etc.

Also in the case of the jerk-type fuel injection system described above, when the cam 126 is rotated by the engine, it causes the rocker arm 122 and the return spring 118 to reciprocate the plunger 114. Thereupon, the fuel fed into the pump chamber 82 is pressurized and supplied from the chamber 82 to a fuel puddle 18 through the discharge passage 83 and the fuel passage 42.

The following is a description of fuel injection control based on the operation of the ECU 102 for opening and closing the first and second solenoid valves 50 and 52.

Preparation for Main Injection

At this time, the ECU 102 energizes the solenoid 56 of the second solenoid valve 52, thereby shifting only the second valve 52 to its open position. Even though the fuel is discharged from the pump chamber 82 as the cam 126 rotates, in this case, the fuel is only discharged from the return passage 132 into the return pipe 58 through the second solenoid valve 52, and the fuel in the fuel puddle 18 cannot be pressurized. As a result, the nozzle needle 20 is subjected to the urging force of a valve spring 26, thereby closing the nozzles 16.

Start of Main Injection

The ECU 102 stops the current supply to the solenoid 56 of the second solenoid valve 52, thereby shifting the second valve 52 to its closed position. In this case, both the first and second solenoid valves 50 and 52 are closed, so that, as the cam 126 rotates, the fuel is discharged from the pump chamber 82, thereby the pressure in the fuel puddle 18 increases. As a result, the nozzle needle 20 is pushed up against the urging force of the valve spring 26, whereupon the nozzles 16 are opened. At this point of time, main fuel injection is started.

Termination of Main Injection

When a predetermined quantity of fuel is injected, thereafter, the ECU 102 energizes the solenoid 54 of the first solenoid valve 50, thereby shifting the first valve 50 from its closed position to its open position. At this point of time, therefore, the fuel pressure in the fuel puddle 18 is allowed to go to the low-pressure side through the first valve 50, so that the nozzle needle 20 is subjected to the urging force of the valve spring 26, thereby closing the nozzles 16.

Table 3 below shows the respective states of the first and second solenoid valves 50 and 52 switched in the aforesaid manner.

TABLE 3

| | Solenoid 54 Valve 50 | Solenoid 56 Valve 52 |
|---|---|---|
| Preparation for | Off | On |
| Fuel Injection | Closed | Open |
| Start of | Off | Off |
| Main Injection | Closed | Closed |
| Termination of | On | Off |
| Main Injection | Open | Closed |

In the case where pilot injection is carried out before the main fuel injection, the ECU 102 controls the switching of the first and second solenoid valves 50 and 52 in the manner shown in Table 4 below.

TABLE 4

| | Solenoid 54 Valve 50 | Solenoid 56 Valve 52 |
|---|---|---|
| Preparation for | Off | On |
| Pilot Injection | Closed | Open |
| Start of | Off | Off |
| Pilot Injection | Closed | Closed |
| Termination of | On | Off |
| Pilot Injection | Open | Closed |
| Preparation for | On | Off |
| Main Injection | Open | Closed |
| Start of | Off | Off |
| Main Injection | Closed | Closed |
| Termination of | Off | On |
| Main Injection | Close | Open |

In the preparation for the pilot injection, the first and second solenoid valves 50 and 52 are switched in the same manner as in the preparation for the main injection.

It is to be understood that the pilot and main injections are carried out during one pressurization stroke of the plunger 114.

In the above embodiment of jerk-type, the connecting passage 128 diverges into the first and second control passages 130 and 131. However, more than two control passages may be formed, provided that at least one solenoid valve is inserted into each control passage.

In the jerk-type fuel injection system described above, as in the accumulator-type fuel injection system, the beginning and termination of the fuel injection can be controlled with high accuracy.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection system of an engine, comprising:

a fuel tank for storing a fuel:

a fuel pressurizing device for pressurizing the fuel supplied from the fuel tank;

an injector for injecting the fuel pressurized by the fuel pressure device into a cylinder of the engine;

a fuel supply passage for connecting the fuel pressurizing device and the injector and for supplying the pressurized fuel from the fuel pressurizing device to the injector;

a fuel return passage for connecting the injector and the fuel tank and for returning the pressurized fuel from the injector to the fuel tank;

at least two solenoid valves arranged in the fuel return passage, said solenoid valves being opened and closed to control fuel injection from the injector, and an accumulator disposed in the fuel supply passage, wherein said injector includes a nozzle connected to the fuel supply passage by means of a connecting passage such that the pressurized fuel is injectable through the nozzle, a pressure chamber into which the pressurized fuel is introduced from the connecting passage, and a nozzle valve for opening and closing the nozzle depending on the fuel pressure in the pressure chamber, said fuel return passage connects the pressure chamber and the fuel tank, said solenoid valves are arranged in series in the fuel return passage, and said nozzle valve opens the nozzle to inject the fuel through the nozzle when all the solenoid valves are opened to lower the fuel pressure in the pressure chamber.

2. The system according to claim 1, which further comprises an accumulator in the fuel supply passage, wherein said injector includes a nozzle connected to the fuel supply passage by means of a connecting passage so that the pressurized fuel can be injected through the nozzle, a pressure chamber into which the pressurized fuel is introduced from the connecting passage, and a nozzle valve for opening and closing the nozzle depending on the fuel pressure in the pressure chamber, said fuel return passage connects the pressure chamber and the fuel tank, said solenoid valves are arranged in series in the fuel return passage, and wherein said nozzle valve opens the nozzle to inject the fuel through the nozzle when all the solenoid valves are opened to lower the fuel pressure in the pressure chamber.

3. The system according to claim 1, wherein said nozzle valve is closed by a pressure in the pressure chamber when one of the solenoid valves is closed to increase the fuel pressure in the pressure chamber.

4. A control method for a fuel injection system of an engine, said fuel injection system including a fuel tank for storing a fuel, a fuel pressurizing device for pressurizing the fuel supplied from the fuel tank, an injector for injecting the pressurized fuel into a cylinder of the engine, a fuel supply passage for connecting the fuel pressurizing device with the injection and for supplying the pressurized fuel from the fuel pressurizing device to the injection, the injector having a nozzle connected to the fuel supply passage by means of a connecting passage, a pressure chamber into which the pressurized fuel is introduced from the connecting passage, and a nozzle valve for opening and closing the nozzle depending on a fuel pressure in the pressure chamber, a fuel return passage for connecting the pressure chamber with the fuel tank and for returning the pressurized fuel from the pressure chamber to the fuel tank, and first and second solenoid valves arranged in series in the fuel return passage, said control method comprising:

an injection starting step for opening all the solenoid valves in the fuel return passage in order to lower the fuel pressure in the pressure chamber, thereby opening the nozzle valve, and injecting the pressurized fuel through the nozzle; and an injection terminating step for closing one of the first and second solenoid valves during fuel injection in order to increase the fuel pressure in the pressure chamber, thereby closing the nozzle valve, and stopping the fuel injection through the nozzle.

5. The control method according to claim 4, which further comprises an injection preparation step for keeping one of said first and second solenoid valves in a closed position thereof and the other of said first and second solenoid valves in an open position, respectively, to provide for another fuel injection cycle after said fuel injection is stopped.

6. The control method according to claim 4, wherein said fuel injection is carried out more than once for each combustion stroke of the engine.

7. The control method according to claim 6, wherein said fuel injection includes pilot injection and main injection.

8. The control method according to claim 6, wherein said fuel injection includes preceding fuel injection and succeeding fuel injection, said preceding fuel injection being carried out by a first injection preparation step for opening said second solenoid valve and closing said first solenoid valve, a first injection starting step for opening said first solenoid valve to start the fuel injection, and a first injection terminating step for closing said second solenoid valve to stop the fuel injection, and said succeeding fuel injection being carried out by a second injection preparation step for keeping said second solenoid valve in the closed position thereof and said first solenoid valve in the open position thereof, a second injection starting step for opening said second solenoid valve to start the fuel injection, and a second injection terminating step for closing said first solenoid valve to terminate the fuel injection.

9. A control method for a fuel injection system of an engine, said fuel injection system comprising a fuel tank for storing with a fuel, a fuel pressurizing device for pressurizing the fuel supplied from the fuel tank, an injector for injecting the pressurized fuel into a cylinder of the engine, a fuel supply passage for connecting the fuel pressurizing device with the injector and for supplying the pressurized fuel from the pressurizing device to the injector, the injector having a nozzle connected to the fuel supply passage by means of a connecting passage, a needle for opening and closing the nozzle, and a spring for urging the needle in the direction to close the nozzle, a fuel return passage for connecting the connecting passage and the fuel tank and for including first and second passage portions parallel to each other, and first and second solenoid valves provided for each of the first and second passage portions, respectively, said control method comprising:

an injection starting step for closing all the solenoid valves in the first and second passage portions in order to increase the fuel pressure in the connecting passage, thereby causing the needle to open the nozzle against the urging force of the spring, and injecting the fuel through the nozzle; and an injection terminating step for opening one of said first and second solenoid valves during fuel injection in order to lower the fuel pressure in the connecting passage, thereby causing the needle to close the nozzle by means of an urging force of the spring, and stopping the fuel injection through the nozzle.

10. The control method according to claim 9, which further comprises an injection preparation step for keeping one of said first and second solenoid valves in a closed position thereof and the other of said first and second solenoid valves in an open position thereof, to provide for another fuel injection cycle after said fuel injection is stopped.

11. The control method according to claim 9, wherein said fuel injection is carried out more than once for each combustion stroke of the engine.

12. The control method according to claim 9, wherein said fuel injection includes pilot injection and main injection.

13. The control method according to claim 11, wherein said fuel injection includes preceding fuel injection and succeeding fuel injection, said preceding fuel injection being carried out by a first injection preparation step for closing said first solenoid valve in said first passage portion and opening said a second solenoid valve in said second passage portion, a first injection starting step for closing said second solenoid valve to start the fuel injection, and a first injection terminating step for opening said first solenoid valve to stop the fuel injection, and said succeeding fuel injection being carried out by a second injection preparation step for keeping said first solenoid valve in the open position thereof and said second solenoid valve in the closed position thereof, a second injection starting step for closing said first solenoid valve to start the fuel injection, and a second injection terminating step for opening said second solenoid valve to terminate the fuel injection.

* * * * *